US010919065B2

(12) United States Patent
Medard et al.

(10) Patent No.: US 10,919,065 B2
(45) Date of Patent: Feb. 16, 2021

(54) SKIRT FOR A ROTARY PROJECTOR OF COATING PRODUCT COMPRISING AT LEAST THREE DISTINCT SERIES OF AIR EJECTING NOZZLES

(71) Applicant: EXEL INDUSTRIES, Epernay (FR)

(72) Inventors: Cyrille Medard, Paris (FR); Sylvain Perinet, Paris (FR); Philippe Provenaz, Paris (FR)

(73) Assignee: EXEL INDUSTRIES, Epernay (FR)

( * ) Notice: Subject to any disclaimer, the term of this patent is extended or adjusted under 35 U.S.C. 154(b) by 188 days.

(21) Appl. No.: 15/643,882

(22) Filed: Jul. 7, 2017

(65) Prior Publication Data

US 2018/0008997 A1 Jan. 11, 2018

(30) Foreign Application Priority Data

Jul. 11, 2016 (FR) ..... 16 56633

(51) Int. Cl.
*B05B 13/04* (2006.01)
*B05B 3/10* (2006.01)

(52) U.S. Cl.
CPC ..... *B05B 13/0431* (2013.01); *B05B 3/1014* (2013.01); *B05B 3/1092* (2013.01); *B05B 3/1064* (2013.01); *B05B 13/0452* (2013.01)

(58) Field of Classification Search
CPC . B05B 3/1014; B05B 3/1092; B05B 13/0431; B05B 15/0431; B05B 13/0452; B05B 3/02; B05B 5/0407; B05B 5/0426; B05B 3/1064
See application file for complete search history.

(56) References Cited

U.S. PATENT DOCUMENTS 5,954,275 A * 9/1999 Honma ..... B05B 3/1064 239/223
8,025,026 B2 * 9/2011 Le Strat ..... B05B 5/1625 118/302
8,481,124 B2 7/2013 Nolte et al.
8,794,177 B2 * 8/2014 Shigekura ..... B05B 3/02 118/323
8,827,181 B2 9/2014 Nolte et al.
(Continued)

FOREIGN PATENT DOCUMENTS

CN 100553791 10/2009
CN 105451824 3/2016
(Continued)

OTHER PUBLICATIONS

Search Report issued for French patent application No. 1656633, dated Mar. 27, 2017, 3 pages.

*Primary Examiner* — Arthur O. Hall
*Assistant Examiner* — Steven M Cernoch
(74) *Attorney, Agent, or Firm* — Duane Morris LLP

(57) ABSTRACT

This skirt (20) is intended to equip a coating product rotary projector. The skirt (20) has a plurality of air ejection nozzles (40, 42, 44, 46) arranged in said skirt (20) to eject jets of air forming shaping air suitable for shaping the jets of coating product, said air ejection nozzles (40, 42, 44, 46) comprising at least three separate series of nozzles (41, 43, 45, 47) each made up of a plurality of air ejection nozzles (40, 42, 44, 46) fluidly connected to a shared supply chamber, specific to said series of nozzles (41, 43, 45, 47).

10 Claims, 8 Drawing Sheets

(56) References Cited

U.S. PATENT DOCUMENTS

Figure 1:
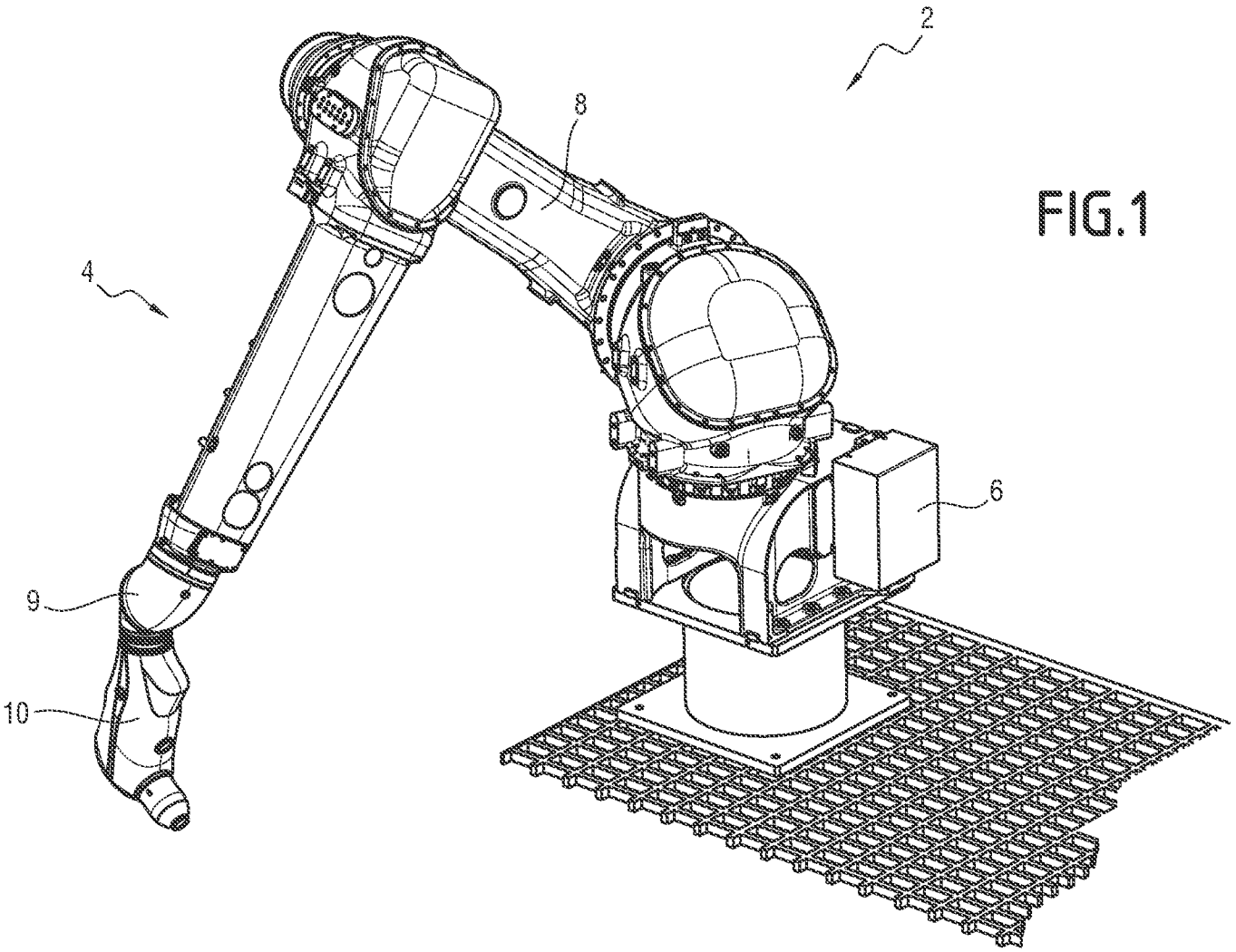

| | | | | |
|---|---|---|---|---|
| 9,174,230 | B2 * | 11/2015 | Anfindsen | B05B 12/1463 |
| 2008/0230003 | A1 | 9/2008 | Le Strat et al. | |
| 2013/0040064 | A1 | 2/2013 | Shigekura et al. | |
| 2020/0171519 | A1 | 6/2020 | Delsard | |

FOREIGN PATENT DOCUMENTS

| | | | |
|---|---|---|---|
| EP | 0801992 | | 10/1997 |
| EP | 2328689 | B1 | 2/2014 |
| FR | 2868342 | A1 | 10/2005 |
| FR | 2917309 | A1 | 12/2008 |
| JP | S63200863 | A | 8/1988 |
| JP | 3473718 | B2 | 12/2003 |
| JP | 2012040498 | A | 3/2012 |
| RU | 2428260 | | 9/2011 |
| RU | 109997 | | 11/2011 |
| RU | 2448780 | | 4/2012 |
| WO | 2011/125855 | A1 | 10/2011 |

* cited by examiner

SKIRT FOR A ROTARY PROJECTOR OF COATING PRODUCT COMPRISING AT LEAST THREE DISTINCT SERIES OF AIR EJECTING NOZZLES

The present invention relates to a skirt for a rotary projector of coating product, of the type comprising a plurality of air ejection nozzles arranged in said skirt to eject jets of air forming shaping air suitable for shaping the jets of coating product, said air ejection nozzles comprising at least one series of nozzles made up of a plurality of air ejection nozzles fluidly connected to a shared supply chamber, specific to said series of nozzles.

Conventional spraying using rotary projectors is used to apply a primer, a base layer and/or a varnish on objects to be coated, such as motor vehicle bodies. A rotary projector for projecting coating product includes a spraying member rotating at a high speed under the effect of a rotational driving system, such as a compressed air turbine.

Such a spraying member generally assumes the form of a bowl symmetrical in revolution and includes at least one spraying edge able to form a jet of coating product. The rotary projector also includes a stationary body housing the rotational driving system, as well as means for supplying the spraying member with coating product.

The jet of coating product sprayed by the edge of the rotating member has a globally conical shape that depends on parameters such as the rotation speed of the bowl and the flow rate of coating product. To control the shape of this product jet, the rotary projectors of the prior art are generally equipped with several air ejection nozzles formed in a skirt equipping the body of the projector and positioned over a circle that is centered on the axis of symmetry of the bowl and that is situated on the outer perimeter of the bowl. The air ejection nozzles are intended to emit jets of air together forming shaping air for the product jet. This shaping air, which is sometimes called "skirt air", makes it possible to shape the product jet, in particular to adjust the width of this jet, as a function of the desired application.

Such a rotary projector is known for example from EP 2,328,689.

One drawback of the known rotary projectors is that they do not make it possible to vary the width of the product jet over a large amplitude without changing skirts. The jet width variation is thus generally of an amplitude comprised between 50 and 300 mm or between 300 and 500 mm. If one wishes to be able to cover the entire spectrum from 50 to 500 mm, it is necessary to change the skirt, which requires complex operations, in particular stopping the rotary projector beforehand.

Yet in several rotary projector applications, it is desirable to allow spraying of the coating product simultaneously in a wide jet, i.e., with a jet width comprised between 300 and 500 mm, and in a narrow jet, i.e., with a jet width comprised between 50 and 300 mm. This need is in particular encountered in the automotive industry, for which body interiors must be painted with a narrow jet and body exteriors with a wide jet. The known rotary projectors not allowing this flexibility, the production lines used in the automotive industry generally incorporate two painting booths: a first dedicated painting body interiors, including a paint projector suitable for producing a narrow jet width, and a second dedicated to painting body exteriors, including a paint projector suitable for producing a wide jet width. This dual painting booth equipment is expensive, both in terms of machine equipment and building space and energy necessary for the operation of the installation.

One aim of the invention is thus to make it possible, with a same rotary projector, to project a coating product in either a wide jet or a narrow jet, without having to change the skirt of the rotary projector.

To that end, the invention relates to a skirt for a rotary projector of the aforementioned type, wherein the air ejection nozzles comprise at least three separate series of nozzles.

According to specific embodiments of the invention, the skirt also has one or more of the following features, considered alone or according to any technically possible combination(s):

- the air ejection nozzles comprise a first group of nozzles, made up of at least a first series of nozzles from among the series of nozzles, and a second group of nozzles, made up of at least a second series of nozzles from among the series of nozzles, the first group of nozzles being such that, when the or each first series of nozzles is supplied with air, the nozzles of the or each first series of nozzles eject first jets of air together forming a first shaping air suitable for shaping the jet of coating product in a narrow manner, and the second group of nozzles being such that, when the or each second series of nozzles is supplied with air, the nozzles of the or each second series of nozzles eject second jets of air together forming a second shaping air suitable for shaping the jet of coating product in a wide manner,
- the first group of nozzles comprises a first series of primary nozzles, made up of first primary nozzles each suitable for ejecting a first primary air jet along a first primary direction, and the second group of nozzles comprises a second series of primary nozzles, separate from the first series of primary nozzles and made up of second primary nozzles each suitable for ejecting a second primary air jet along a second primary direction different from the first primary direction,
- the first primary direction is defined by a first primary unitary vector having a first primary radial divergence component, and the second primary direction is defined by a second primary unitary vector having a second primary radial divergence component, the second primary radial divergence component being greater than the first primary radial divergence component,
- the first primary direction is defined by a first primary unitary vector having a first primary orthoradial component, and the second primary direction is defined by a second primary unitary vector having a second primary orthoradial component, the second primary orthoradial component being greater than the first primary orthoradial component,
- each of the first and second primary directions is defined by a primary unitary vector having a non-zero primary orthoradial component,
- the first group of nozzles comprises a first series of secondary nozzles, separate from the first and second series of primary nozzles, and the second group of nozzles comprises a second series of secondary nozzles, separate from the first and second series of primary nozzles,
- the first and second series of secondary nozzles are separate from one another,
- the first nozzles of the first series of primary and secondary nozzles are positioned alternating relative to one another, and/or the second nozzles of the second series of primary and secondary nozzles are positioned alternating relative to one another, each of the nozzles of the first series of secondary nozzles is suitable for ejecting a first secondary air jet along a first secondary direction different from the first primary direction and preferably substantially secant to the first primary direction in a first intersection region, each of the nozzles of the second series of secondary nozzles is suitable for ejecting a second secondary air jet along a second secondary direction different from the second primary direction and preferably substantially secant to the second primary direction in a second intersection region, the first nozzles are positioned within a separating perimeter, the second nozzles being positioned outside the separating perimeter, or the first nozzles are positioned outside a separating perimeter, the second nozzles being positioned inside the separating perimeter, and each supply chamber is formed in the skirt.

The invention also relates to a rotary projector for a coating product including at least one member for spraying the coating product, a driving system for rotating the first spraying member around an axis, and a stationary skirt, the skirt being made up of a skirt as described above, and each of the supply chambers being formed in the rotary projector.

According to one particular embodiment of the invention, the covering method also has the following feature:

the spraying member has at least one globally circular edge, each of the air ejection nozzles being at a distance from the rotation axis greater than or equal to the half-diameter of the edge.

The invention also relates to a spraying robot containing an articulated arm, a wrist mounted at one end of the articulated arm, and a rotary projector attached on the wrist, wherein the rotary projector is a rotary projector as described above.

Lastly, the invention also relates to a method for covering at least part of at least one object with a coating product projected using a rotary projector as described above, wherein the air ejection nozzles comprise a first group of nozzles, made up of at least a first series of nozzles from among the series of nozzles, and a second group of nozzles, made up of at least a second series of nozzles from among the series of nozzles, the method comprising the following steps:

projecting a first jet of coating product using the rotary projector, only the air ejection nozzles of the first group of nozzles being supplied with air, said air ejection nozzles ejecting first air jets together forming a first shaping air shaping the first jet of coating product in a narrow manner, and before or after the step for projecting a first jet of coating product, projecting a second jet of coating product using the rotary projector, only the air ejection nozzles of the second group of nozzles being supplied with air, said air ejection nozzles ejecting second air jets together forming a second shaping air shaping the second jet of coating product in a wide manner.

According to specific embodiments of the invention, the covering method also has one or more of the following features, considered alone or according to any technically possible combination(s):

the method comprises, between the step for projecting the first jet of coating product and the step for projecting the second jet of coating product, a step for replacing the spraying member with another spraying member, the first jet of coating product is sprayed on a first narrow surface and the second jet of coating product is sprayed on a second wide surface, the first jet of coating product is sprayed on a first object with small dimensions and the second jet of coating product is sprayed on a second object with large dimensions, and when the first jet of coating project is projected, the rotary projector is equipped with a mixed spraying member and, when the second jet of coating product is projected, the rotary projector is equipped with the same mixed spraying member.

Figure 2:
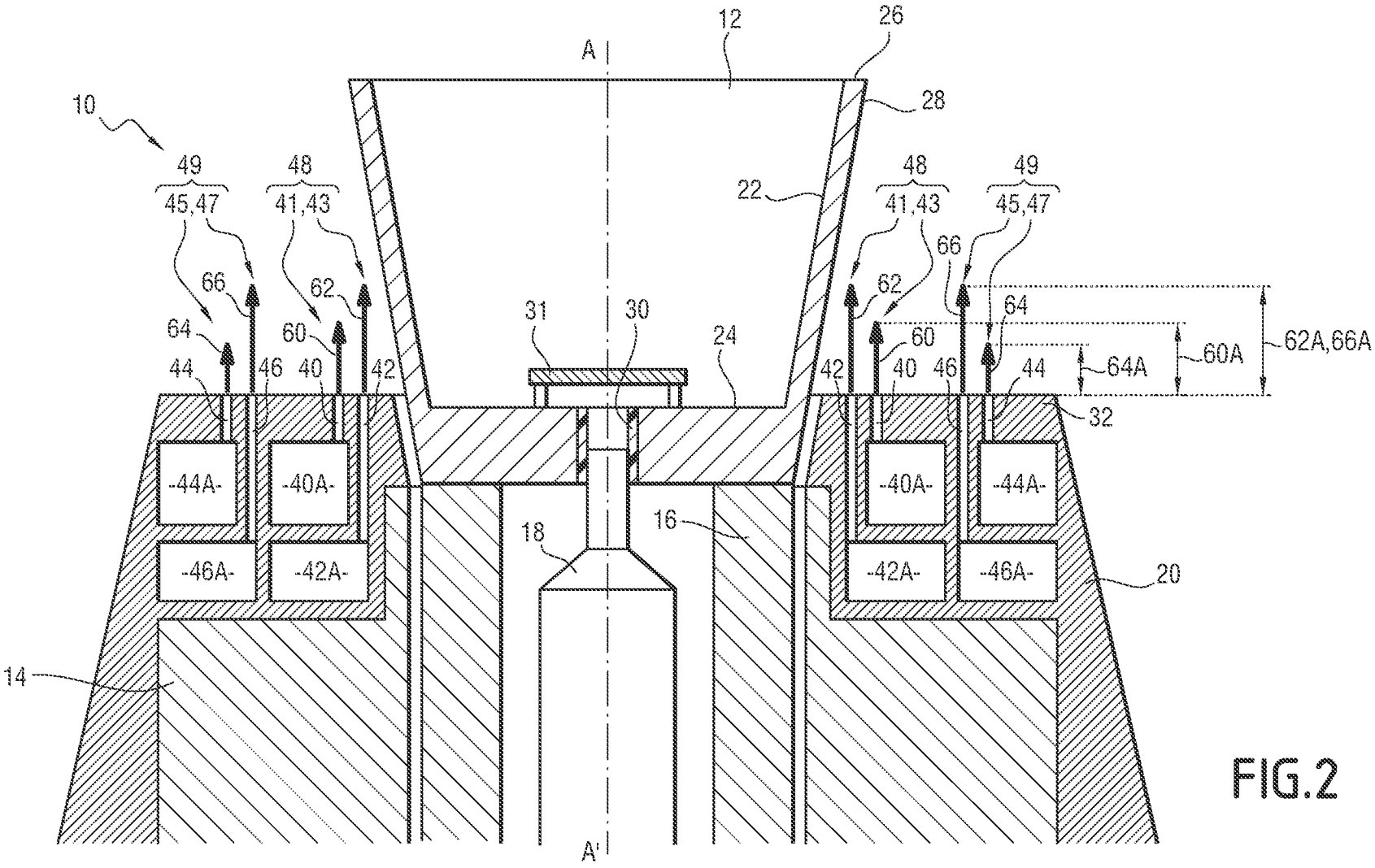
Figure 3:
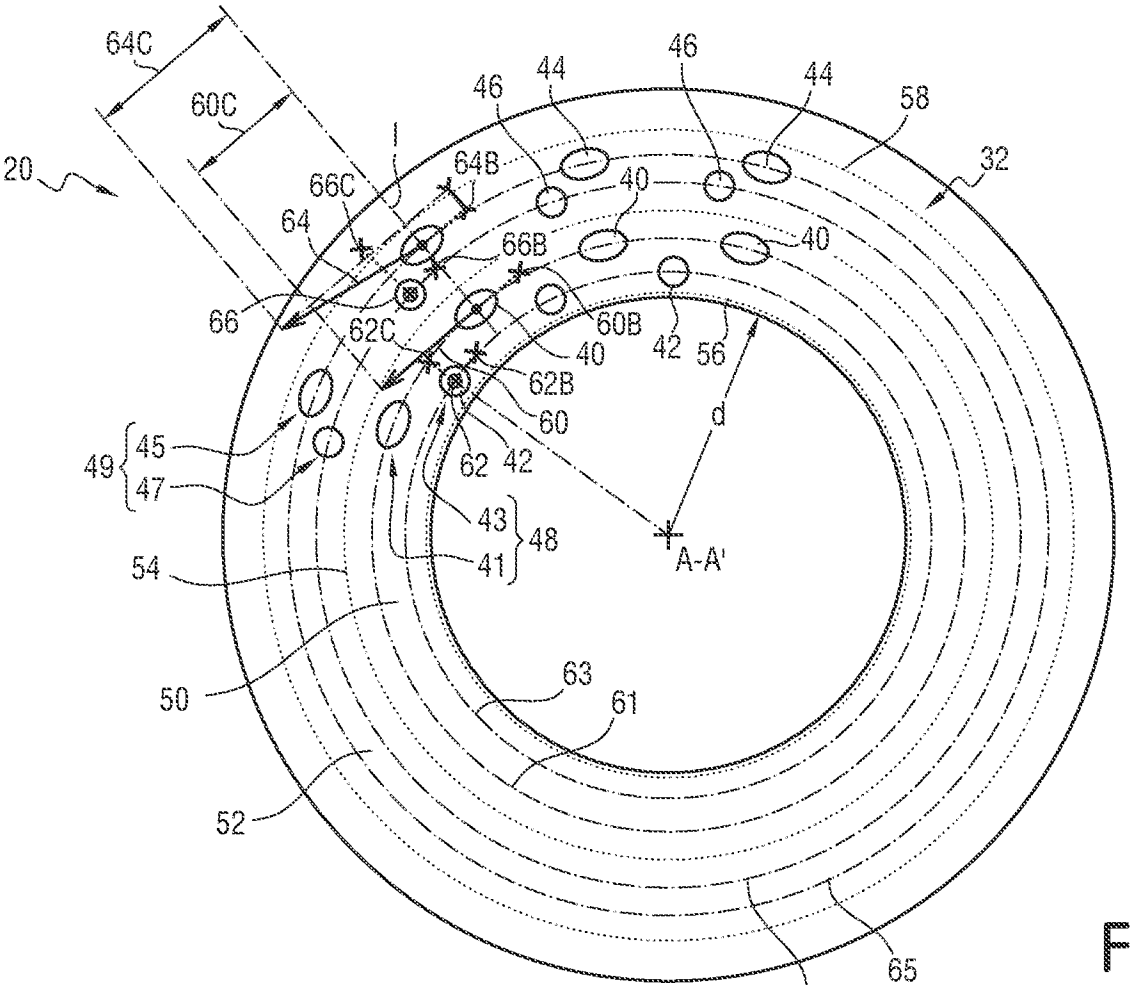
Figure 4:
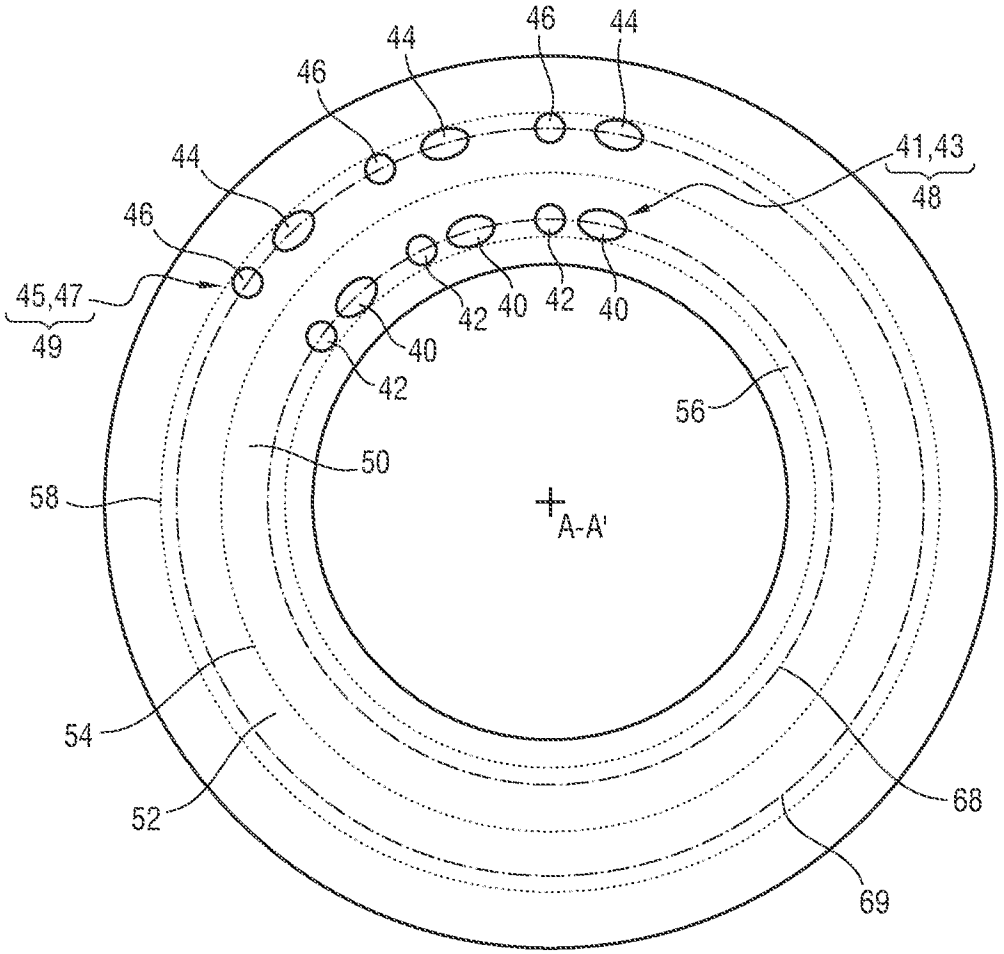
Figure 5:
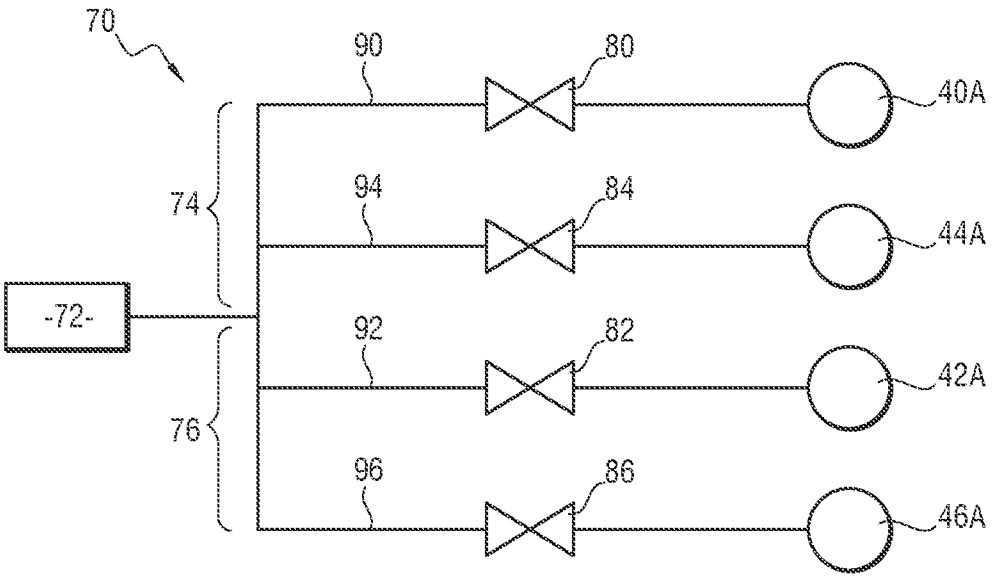
Figure 6:
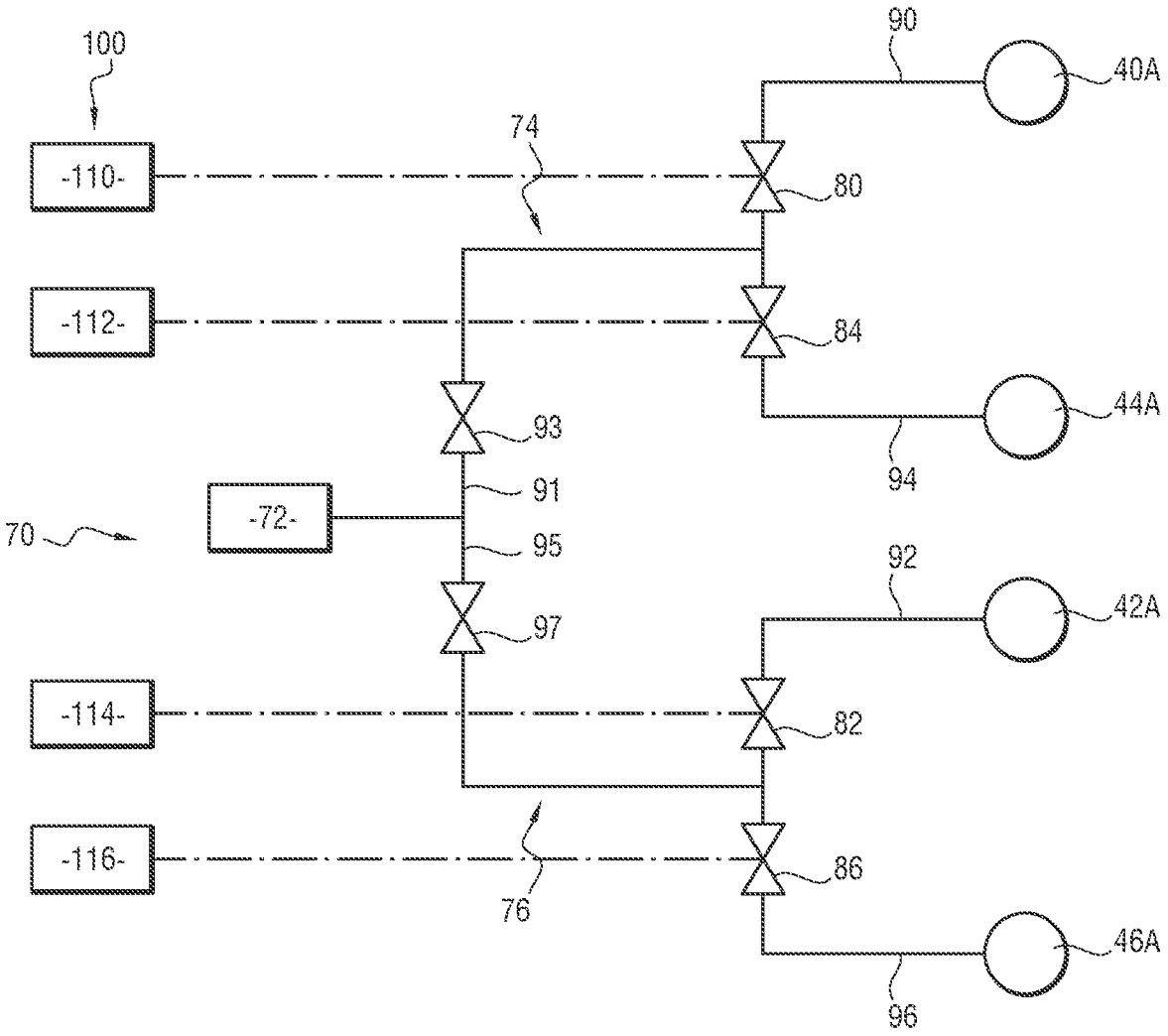
Figure 7:
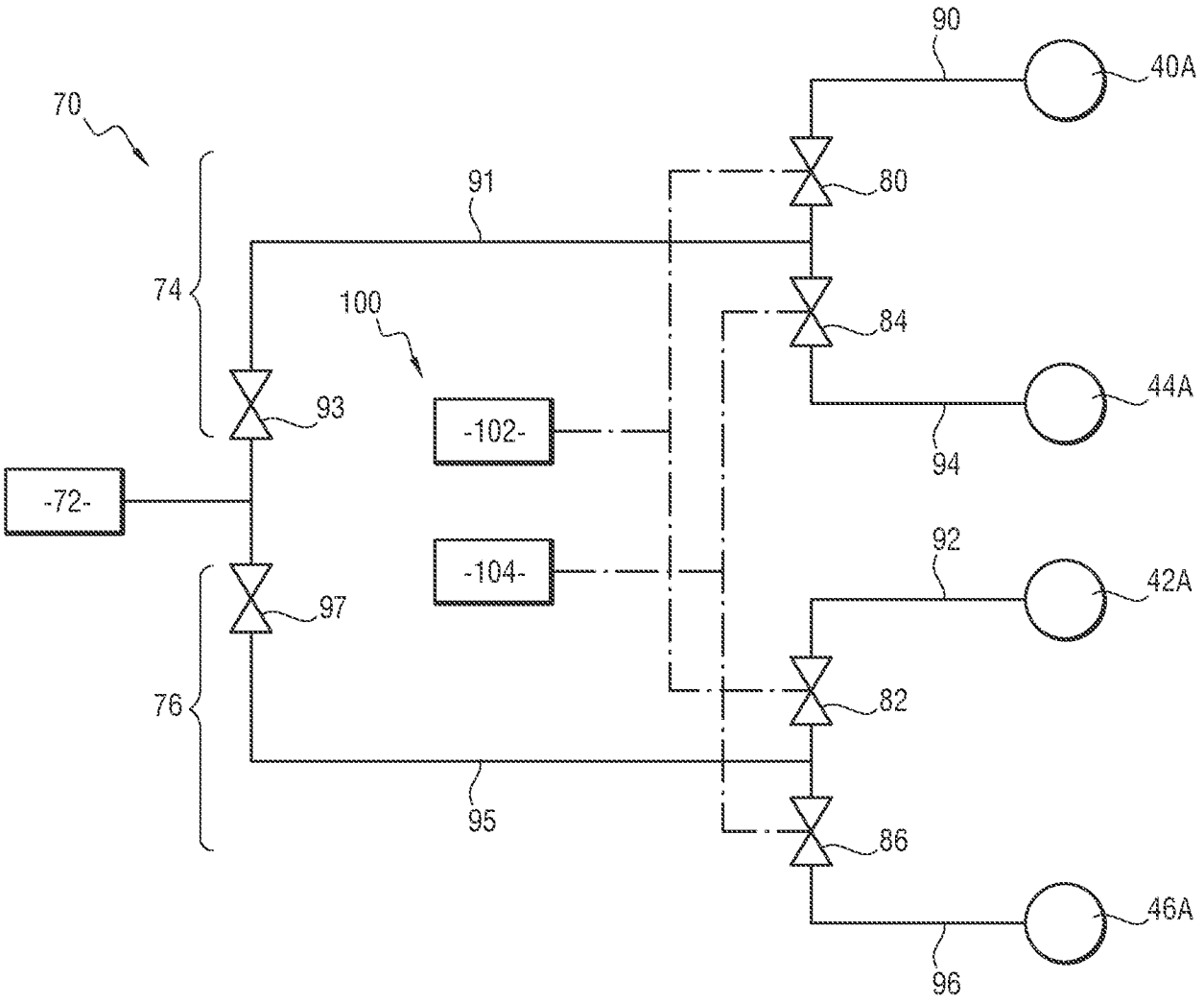
Figure 8:
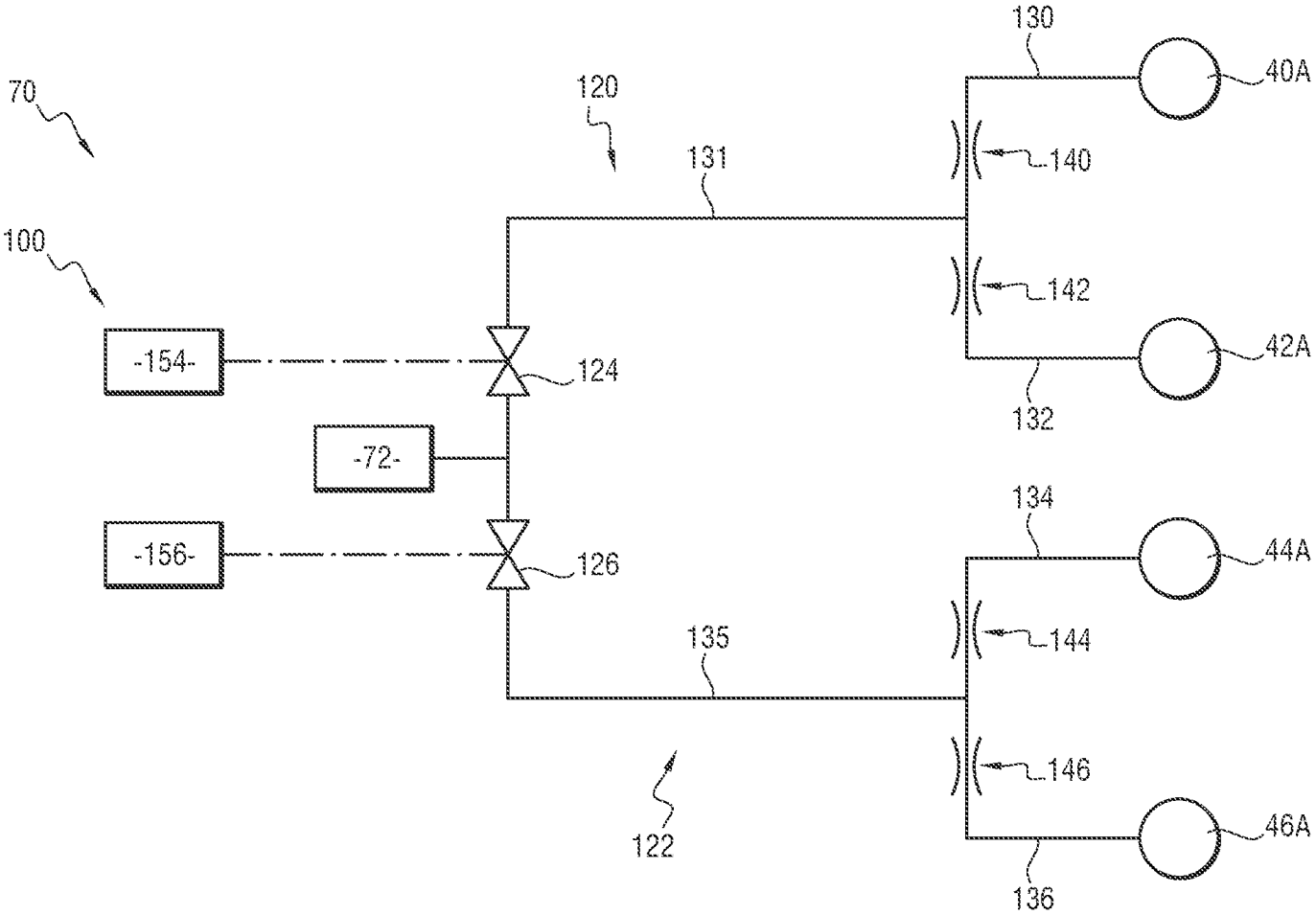

Other features and advantages of the invention will appear more clearly upon reading the following description, provided solely as an example and done in reference to the appended drawings, in which:

FIG. 1 is a perspective view of a coating installation according to the invention, FIG. 2 is an axial sectional view of a rotary projector of the coating installation of FIG. 1, according to a first embodiment of the invention, FIG. 3 is a top view of the skirt of the rotary projector of FIG. 2, the cutting plane of FIG. 2 being embodied by the line marked II in this figure, FIG. 4 is a top view of the skirt of a rotary projector of the coating installation of FIG. 1, according to a second embodiment, FIG. 5 is a diagram illustrating a first alternative of a first example embodiment of an air supply system for the coating installation of FIG. 1, FIG. 6 is a diagram illustrating a second alternative of the air supply system for the coating installation of FIG. 5, FIG. 7 is a diagram illustrating a third alternative of the air supply system for the coating installation of FIG. 5, and FIG. 8 is a diagram illustrating a second example embodiment of an air supply system for the coating installation of FIG. 1.

The coating installation 2 shown in FIG. 1 is intended to spray a coating product on a surface to be coated. In a known manner, it comprises a multiaxial spraying robot 4 and an electropneumatic control cabinet 6 to control the robot 4.

The spraying robot 4 comprises an articulated arm 8, a wrist 9 mounted at one end of the articulated arm 8, and a rotary projector 10 attached on the wrist 9.

In reference to FIG. 2, the rotary projector 10 comprises a spraying member 12, a body 14, a system 16 for rotating the spraying member 12 around an axis A-A' relative to the body 14, a system 18 for supplying the spraying member 12 with coating product, and a skirt 20 equipping the outside of the body 14.

Hereinafter, the orientation terms should be understood as follows:

"axial" refers to elements oriented parallel to the axis A-A',

"radial" refers to elements oriented perpendicular to the axis A-A', and

"orthoradial" refers to elements oriented orthogonally to the axis A-A' and perpendicular to a radial direction.

Furthermore, the terms "upstream" and "downstream" should be understood in reference to the direction of flow of the coating product through the rotary projector 10.

The spraying member 12 has a symmetry of revolution, i.e., an axis exists, qualified as axis of the first spraying member, such that any image of the spraying member 12 obtained by rotating the spraying member 12 around said axis, irrespective of the angle of this rotation, is identical to the spraying member 12.

The spraying member 12 has a distribution surface 22, oriented toward the axis of the first spraying member, that becomes wider from a bottom 24 of the spraying member 12, close to the body 14, up to a spraying edge 26, far from the body 14 and defining a downstream end of the spraying member 12 opposite the body 14.

The edge 26 is substantially circular and has a diameter, hereinafter described as "diameter of the spraying member 12".

The spraying member 12 also has an outer surface 28 oriented opposite the axis of the first spraying member. This outer surface 28 also becomes wider, in the illustrated example, from the bottom 24 up to the edge 26. The spraying member 12 is thus generally bowl-shaped and will, as a result, be referred to hereinafter using the term "bowl".

The bottom 24 has an orifice 30 for introducing coating product, fluidly connected to the supply system 18. A dispenser 31 is secured to the bowl 12, across from the orifice 30, so as to channel and distribute the coating product on the distribution surface 22.

In the illustrated example, the bowl 12 is mounted on the body 14 such that its axis is substantially coaxial to the axis of rotation A-A' and so as to be connected to the drive system 16, so that the drive system 16 can rotate the bowl 12 around the axis A-A'. Advantageously, the bowl 12 is connected to the drive system 16 using a reversible connecting member (not shown) identical to that described in patent FR 2,868,342, the content of which must be considered to be part of this application.

In the illustrated example, the bowl 12 is a mixed spraying member, i.e., suitable for projecting the coating product both in a wide jet and a narrow jet. To that end, the diameter of the bowl 12 is preferably comprised between 30 and 90 mm, advantageously between 50 and 65 mm.

Alternatively (not shown), the bowl 12 is suitable only for projecting the coating product in a narrow jet. The rotary projector 10 then also comprises a second spraying member, separate from the body 14 and identical to the bowl 12 except for its diameter, which, for this second spraying member, is larger than the diameter of the bowl 12.

The body 14 is fastened to the wrist 9 of the spraying robot 4.

The drive system 16 is typically formed by a compressed air turbine. Alternatively, the drive system 16 is formed by an electric motor.

The supply system 18 is fluidly connected to a source (not shown) of coating product, typically made up of paint, and is suitable for driving this coating product to the introduction orifice 30 of the bowl 12.

The skirt 20 is stationary relative to the body 14 and at least partially covers an outer surface of the body 14. Moreover, in the illustrated example, the skirt 20 radially surrounds the bottom 24 of the bowl 12, such that the bowl 12 is partially inserted into the skirt 20.

The skirt 20 has a plurality of air ejection nozzles 40, 42, 44, 46 arranged in said skirt 20.

Each nozzle 40, 42, 44, 46 is arranged in a planar radial surface 32 of said skirt 20. This radial surface 32 is, in the illustrated example, shared by all of the nozzles 40, 42, 44, 46, and forms a downstream end of the skirt 20. Alternatively (not shown), at least one of the nozzles 40, 42, 44, 46 is arranged in a radial surface axially offset relative to another radial surface in which at least one of the other nozzles 40, 42, 44, 46 is arranged.

Alternatively, at least one of the nozzles 40, 42, 44, 46 is arranged on any three-dimensional surface of revolution around A-A'.

The air ejection nozzles 40, 42, 44, 46 fluidly communicate with chambers 40A, 42A, 44A, 46A supplying air for said air ejection nozzles 40, 42, 44, 46, each formed in the rotary projector 10. In particular, each of these supply chambers 40A, 42A, 44A, 46A is, in the illustrated example, formed in the skirt 20. Alternatively, at least one of these supply chambers 40A, 42A, 44A, 46A is formed at the interface between the skirt 20 and the body 14. Also alternatively, at least one of these supply chambers 40A, 42A, 44A, 46A is formed in the body 14.

Each air ejection nozzle 40, 42, 44, 46 is preferably made up of a through orifice arranged in the skirt 20. In the illustrated example, this through orifice emerges, by a first end, in the radial surface 32, and, by a second end, in the chamber 40A, 42A, 44A, 46A supplying air to said air ejection nozzle 40, 42, 44, 46. Alternatively, each air ejection nozzle 40, 42, 44, 46 is preferably made up of an element attached on the skirt 20.

For simplification reasons, only some of these air nozzles 40, 42, 44, 46 are shown in the figures, in particular in FIGS. 3 and 4.

The air ejection nozzles 40, 42, 44, 46 comprise four separate series of nozzles 41, 43, 45, 47, each series of nozzles 41, 43, 45, 47, respectively, being made up of a plurality of nozzles 40, 42, 44, 46, respectively, fluidly connected to a shared supply chamber 40A, 42A, 44A, 46A, respectively, specific to said series of nozzles 41, 43, 45, 47. The series of nozzles 41, 43, 45, 17 thus comprise a first series of primary nozzles 41, made up of first primary nozzles 40 fluidly connected to a first primary chamber 40A, a first series of secondary nozzles 43, made up of first secondary nozzles 42 fluidly connected to a first secondary chamber 42A, a second series of primary nozzles 45, made up of second primary nozzles 44 fluidly connected to another second primary chamber 44A, and a second series of secondary nozzles 47, made up of second secondary nozzles 46 fluidly connected to a second secondary chamber 46A.

In reference to FIGS. 3 and 4, the first primary and secondary nozzles 40, 42 are, in the illustrated example, positioned on an inner crown 50, and the second primary and secondary nozzles 44, 46 are positioned on an outer crown 52. The first primary and secondary nozzles 40, 42 will therefore subsequently also be described as "inside air ejection nozzles", and the second primary and secondary nozzles 44, 46 will also be described as "outside air ejection nozzles".

The inner and outer crown 50, 52 are substantially concentric and both substantially have the rotation axis A-A' as center. The inner crown 50 is placed inside a separating perimeter 54 and the outer crown 50 is placed outside this separating perimeter 54, such that the outer crown 52 radially surrounds the inner crown 50.

The separating perimeter 54 is convex, i.e., for any pair of points belonging to the perimeter 54, there is no point of the perimeter 54 inserted between the cord segment connecting said two points and the axis A-N. In particular, the separating perimeter 54 is, as shown, substantially circular. Furthermore, the separating perimeter 54 is substantially centered on the axis A-A'.

Each of the inner and outer crowns 50, 52 is defined, on the side of the axis A-A', by an inner perimeter, and on the side opposite the axis A-A', by an outer perimeter. The separating perimeter 54 constitutes the outer perimeter of the inner crown 50, and the inner perimeter of the outer crown 52. The inner perimeter 56 of the inner crown 50 is made up of a convex perimeter flush with at least part of the inside air ejection nozzles 40, 42; it is preferably circular. The outer perimeter 58 of the outer crown 52 is made up of a convex perimeter flush with at least part of the outside air ejection nozzles 44, 46; it is also preferably circular.

Each of the air ejection nozzles 40, 42, 44, 46 is at a distance from the rotation axis A-A', considered to be the distance from the center of the nozzle 40, 42, 44, 46 to the rotation axis A-A', greater than or equal to the half-diameter of the edge 26. In particular, the inner crown 50 has a minimal radial distance d from the rotation axis A-A', made up of the minimal radial distance from the inner perimeter 56 to the rotation axis A-A', greater than or equal to the half-diameter of the edge 26 of the bowl 12.

Each of the first primary nozzles 40 is suitable for ejecting a first primary air jet along a first primary direction defined by a first primary unitary vector 60 having a first primary axial component 60A, a first primary radial divergence component 60B, and a first primary orthoradial component 60C.

"Unitary vector" means that the vector 60 has a norm, equal to the square root of the sum of the squares of the axial 60A, radial divergence 60B and orthoradial 60C components, substantially equal to 1, some of the components 60A, 60B, 60C being able to be zero. The radial divergence component 60B is a relative value counted positively when the vector 60 is oriented opposite the rotation axis A-A', and negatively when the vector 60 is oriented toward the rotation axis A-N. These definitions also apply to the other vectors qualified as unitary hereinafter.

Preferably, the first primary axial and orthoradial components 60A, 60C are each nonzero.

The diameter of the orifices making up the first primary nozzles 40 is comprised between 0.5 and 1.2 mm.

Each of the first secondary nozzles 42 is suitable for ejecting a first secondary air jet along a first secondary direction defined by a first secondary unitary vector 62 having a first primary axial component 62A, a first primary radial divergence component 62B, and a first primary orthoradial component 62C. The first secondary direction is different from the first primary direction, i.e., at least one of said components 62A, 62B, 62C of the first secondary unitary vector 62 is different from the component 60A, 60B, 60C of the corresponding first primary unitary vector 60.

In particular, the first secondary orthoradial component 62C is smaller than the first primary orthoradial component 60C. Preferably, the first secondary orthoradial component 62C is chosen such that the angle formed in an orthoradial plane between the first secondary unitary vector 66 and the axial direction passing through the first secondary nozzle 42 is less than 30°.

Advantageously, the positions of the first primary nozzles 40 and the first secondary nozzles 42, as well as the components 60A, 60B, 60C of the first primary unitary vector 60 and the components 62A, 62B, 62C of the first secondary unitary vector 62 are chosen such that the first primary and secondary directions are substantially secant to one another in a first intersection region (not shown) situated upstream from the edge 26.

The diameter of the orifices making up the first secondary nozzles 42 is comprised between 0.5 and 1.2 mm.

The first primary and secondary nozzles 40, 42 are positioned alternating relative to one another, i.e., for each pair of adjacent primary nozzles 40, there is a first secondary nozzle 42 inserted angularly between said nozzles 40, and vice versa. The first primary and secondary nozzles 40, 42 are thus equal in number.

In the first embodiment, shown in FIGS. 2 and 3, the first primary and secondary nozzles 40, 42 are positioned on different contours 61, 63, said contours 61, 63 being substantially centered on the axis A-A' and being homothetic to one another, the first primary nozzles 40 being radially offset toward the axis A-A' relative to the first secondary nozzles 42. Alternatively, the first primary and secondary nozzles 40, 42 are positioned on a same contour 68, substantially centered on the axis A-A', like in the second embodiment.

Each of the second primary nozzles 44 is suitable for ejecting a second primary air jet along a second primary direction defined by a second primary unitary vector 64 having a second primary axial component 64A, a second primary radial divergence component 64B, and a second primary orthoradial component 64C.

Preferably, the second primary axial and orthoradial components 64A, 64C are each nonzero.

The diameter of the orifices making up the second primary nozzles 44 is comprised between 0.5 and 1.2 mm.

Each of the second secondary nozzles 46 is suitable for ejecting a second secondary air jet along a second secondary direction defined by a second secondary unitary vector 66 having a second secondary axial component 66A, a second secondary radial divergence component 66B, and a second secondary orthoradial component 66C. The second secondary direction is different from the second primary direction, i.e., at least one of said components 66A, 66B, 66C of the second secondary unitary vector 66 is different from the component 64A, 64B, 64C of the corresponding second primary unitary vector 64.

In particular, the second secondary orthoradial component 66C is smaller than the second primary orthoradial component 64C. Preferably, the second secondary orthoradial component 66C is chosen such that the angle formed in an orthoradial plane between the second secondary unitary vector 66 and the axial direction passing through the second secondary nozzle 46 is less than 30°.

Advantageously, the positions of the second primary nozzles 44 and the second secondary nozzles 46, as well as the components 64A, 64B, 64C of the second primary unitary vector 64 and the components 66A, 66B, 66C of the second secondary unitary vector 66 are chosen such that the second primary and secondary directions are substantially secant to one another in a second intersection region (not shown) situated upstream from the edge 26.

The second primary and secondary nozzles 44, 46 are positioned alternating relative to one another, i.e., for each pair of adjacent second nozzles 44, there is a second secondary nozzle 46 inserted angularly between said nozzles 44, and vice versa. The second primary and secondary nozzles 44, 46 are thus equal in number.

The number of outside air ejection nozzles 44, 46 is greater than or equal to the number of inside air ejection nozzles 40, 42.

The diameter of the orifices making up the second secondary nozzles 66 is comprised between 0.5 and 1.2 mm.

In the first embodiment, the second primary and secondary nozzles 44, 46 are positioned on different contours 65, 67, said contours 65, 67 being substantially centered on the axis A-A' and being homothetic to one another, the second primary nozzles 44 being radially offset toward the axis A-A' relative to the second secondary nozzles 46. Alternatively, the second primary and secondary nozzles 44, 46 are positioned on a same contour 69, substantially centered on the axis A-A', like in the second embodiment.

The first series of primary nozzles 41 and the first series of secondary nozzles 43 together constitute a first pair of series 48 suitable so that, when said series 41, 43 are simultaneously supplied with air, the first air jets ejected by the nozzles 40, 42 making up these series 41, 43 together form a first shaping air suitable for shaping the jet of coating product in a narrow manner. The second series of primary nozzles 45 and the second series of secondary nozzles 47 together constitute a second pair of series 49 suitable so that, when said series 45, 47 are simultaneously supplied with air, the second air jets ejected by the nozzles 44, 46 making up these series 45, 47 together form a second shaping air suitable for shaping the jet of coating product in a wide manner.

To that end, the first and second primary directions are different, i.e., at least one of said components 64A, 64B, 64C of the second primary unitary vector 64 is different from the component 60A, 60B, 60C of the corresponding first primary unitary vector 60. In particular, the second secondary orthoradial component 64C is greater than the first primary orthoradial component 60C, and the second primary radial divergence component 64B is greater than the first primary radial divergence component 60B.

Thus, the first primary orthoradial component 60C is chosen such that the angle formed in an orthoradial plane between the first primary unitary vector 60 and the axial direction passing through the first primary nozzle 40 is comprised between 20° and 50°, preferably between 35° and 45°, the first primary radial divergence component 60B being chosen such that the angle formed in a radial plane between the first primary unitary vector 60 and the radial direction passing through the first primary nozzles 40 is substantially equal to 90°, while the second primary orthoradial component 64C is chosen such that the angle formed in an orthoradial plane between the second primary unitary vector 64 and the axial direction passing through the second primary nozzle 44 is comprised between 40° and 80°, preferably between 50° and 60°, the second primary radial divergence component 64B being chosen such that the angle formed in a radial plane between the second primary unitary vector 64 and the radial direction passing through the second primary nozzle 44 is less than 85°, preferably comprised between 75° and 85°.

Aside from the robot 4 and the cabinet 6, the coating installation 2 comprises, as shown in FIGS. 5 to 8, a system 70 for supplying the nozzles 40, 42, 44, 46 with air.

This supply system 70 comprises, according to a first example embodiment shown in FIGS. 5 to 8, an air source 72, a primary channel 74 supplying the primary air nozzles 40, 44 with air, specific to said primary air nozzles 40, 44, a secondary channel 76 supplying the secondary air nozzles 42, 46 with air, specific to said secondary air nozzles 42, 46, a first primary valve 80 to regulate the supply of the first primary nozzles 40 with air, a first secondary valve 82 to regulate the supply of the first secondary nozzles 42 with air, a second primary valve 84 to adjust the supply of the second primary nozzles 44 with air, and a second secondary valve 86 to regulate the supply of the second secondary nozzles 46 with air.

The air source 72 is typically made up of an air compressor.

The primary channel 74 comprises a first primary branch 90 specific to the first primary nozzles 40 and a second primary branch 94 specific to the second primary nozzles 44. The first primary branch 90 is equipped with the first primary valve 80 such that said valve 80 regulates the air flow circulating in the first primary branch 90. The second primary branch 94 is equipped with the second primary valve 84 such that said valve 84 regulates the air flow circulating in the second primary branch 94.

In the first alternative of FIG. 5, the primary branch 74 is made up of said specific branches 90, 94. Each of the valves 80, 84 is then made up of a variable valve.

In the second and third alternatives of FIGS. 6 and 7, the primary valve 74 also comprises a branch 91 shared by all of the primary air nozzles 40, 44, extending between the source 72 and each of the specific branches 90, 94. This shared branch 91 is equipped with a shared primary valve 93, preferably made up of a variable valve, suitable for adjusting the air flow circulating in the shared branch 91. The valves 80, 84 are then made up of all-or-nothing valves. This makes it possible, compared with the first alternative, to simplify the management of the air supply at the automaton, to reduce the number of pipes entering the rotary projector 10, and to reduce the material and integration cost.

The secondary channel 76 comprises a first secondary branch 92 specific to the first secondary nozzles 42 and a second secondary branch 96 specific to the second secondary nozzles 46. The first secondary branch 92 is equipped with the first secondary valve 82 such that said valve 82 regulates the air flow circulating in the first secondary branch 92. The second secondary branch 96 is equipped with the second secondary valve 86 such that said valve 86 regulates the air flow circulating in the second secondary branch 96.

In the first alternative of FIG. 5, the secondary branch 76 is made up of said specific branches 92, 96. Each of the valves 82, 86 is then made up of a variable valve.

In the second and third alternatives of FIGS. 6 and 7, the secondary valve 76 also comprises a branch 95 shared by all of the secondary air nozzles 42, 46, extending between the source 72 and each of the specific branches 92, 96. This shared branch 95 is equipped with a shared primary valve 97, preferably made up of a variable valve, suitable for adjusting the air flow circulating in the shared branch 95. The valves 82, 86 are then made up of all-or-nothing valves. This makes it possible, compared with the first alternative, to simplify the management of the air supply at the automaton, to reduce the number of pipes entering the rotary projector 10, and to reduce the material and integration cost.

The valves 80, 82, 84, 86 are preferably integrated into the rotary projector 10, in particular the skirt 20. Alternatively, the valves 80, 82, 84, 86 are integrated into the articulated arm 8, or the electropneumatic control cabinet 6.

The coating installation 2 also comprises a system 100 for controlling the supply system 70. This control system 100 is suitable for controlling each of the valves 80, 82, 84, 86.

The control system 100 preferably comprises two separate control modules 102, 104: a first control module 102 for controlling the supply of the first air nozzles 40, 42, and a second control module 104 for controlling the supply of the second air nozzles 44, 46, like in the third alternative shown in FIG. 7. The first control module 102 is then suitable for simultaneously commanding the valves 80 and 82, but not the valves 84 and 86, and the second control module 104 is suitable for simultaneously commending the valves 84 and 86, but not the valves 80 and 82.

Each of the control modules 102, 104 has a connection for a control member (not shown) and is suitable for actuating the valves 80, 82, 84, 86 that it commands when the control member is connected to said connection. For example, the control member is a pneumatic actuator, the control module 102, 104 then comprising a pneumatic circuit connecting the connection of said module 102, 104 to the valves 80, 82, 84, 86 controlled by said module 102, 104, said valves 80, 82, 84, 86 then being formed by pneumatically-controlled valves. Alternatively, the control member is a hydraulic actuator, the control module 102, 104 then comprising a hydraulic circuit connecting the connection of said module 102, 104 to the valves 80, 82, 84, 86 controlled by said module 102, 104, said valves 80, 82, 84, 86 then being formed by hydraulically-controlled valves. Also alternatively, the control member is an electric actuator, the control module 102, 104 then comprising an electric circuit connecting the connection of said module 102, 104 to the valves 80, 82, 84, 86 controlled by said module 102, 104, said valves 80, 82, 84, 86 then being formed by electrically-controlled valves.

Having shared control modules 102, 104 for several valves 80, 82, 84, 86 thus makes it possible to reduce the number of control connections, as well as allowing perfect synchronization of the control of the first valves 80, 82 on the one hand and the second valves 84, 86 on the other hand.

Alternatively, the control system 100 comprises a specific control module 110, 112, 114, 116 for each of the valves 80, 82, 84, 86, like in the second alternative shown in FIG. 6. Each of these control modules 110, 112, 114, 116, respectively, is then suitable for controlling only one valve 80, 82, 84, 86, respectively.

Each of the control modules 110, 112, 114, 116 has a connection for a control member (not shown) and is suitable for actuating the valve 80, 82, 84, 86 that it commands when the control member is connected to said connection. For example, the control member is a pneumatic actuator, the control module 110, 112, 114, 116 then comprising a pneumatic circuit connecting the connection of said module 110, 112, 114, 116 to the valve 80, 82, 84, 86 controlled by said module 110, 112, 114, 116, said valves 80, 82, 84, 86 then being formed by a pneumatically-controlled valve. Alternatively, the control member is a hydraulic actuator, the control module 110, 112, 114, 116 then comprising a hydraulic circuit connecting the connection of said module 110, 112, 114, 116 to the valve 80, 82, 84, 86 controlled by said module 110, 112, 114, 116, said valves 80, 82, 84, 86 then being formed by a hydraulically-controlled valve. Also alternatively, the control member is an electric actuator, the control module 110, 112, 114, 116 then comprising an electric circuit connecting the connection of said module 110, 112, 114, 116 to the valve 80, 82, 84, 86 controlled by said module 110, 112, 114, 116, said valves 80, 82, 84, 86 then being formed by an electrically-controlled valve.

This alternative allows greater flexibility in the control of the valves 80, 82, 84, 86, and therefore in the use of the air nozzles 40, 42, 44, 46, and in particular allows the simultaneous use of the primary inside nozzles 40 with the primary outside nozzles 44 and/or the secondary inside nozzles 42 with the secondary outside nozzles 46 and/or the primary inside nozzles 40 with the secondary outside nozzles 46 and/or the secondary inside nozzles 42 with the primary outside nozzles 44 and/or the primary inside nozzles 40 with the secondary inside nozzles 42 and/or the primary outside nozzles 44 with the secondary outside nozzles 46.

In reference to FIG. 8, the supply system 70 according to the second embodiment differs from the first example embodiment in that it does not comprise a primary channel supplying the primary air nozzles 40, 44 with air, specific to said primary air nozzles 40, 44, or a secondary channel supplying the secondary air nozzles 42, 46 with air, specific to said secondary air nozzles 42, 46, or a valve specific to each of the series of nozzles 41, 43, 45, 47. Instead, the supply system 70 comprises a first supply channel 120, specific to the first pair of series 48, a second supply channel 122, specific to the second pair of series 49, a first valve 124 for regulating the air supply of the first pair of series 48, and a second valve 126 for regulating the air supply of the second pair of series 49.

The first primary channel 120 comprises a first primary branch 130 specific to the first primary nozzles 40 and a first secondary branch 132 specific to the first secondary nozzles 42. The first primary branch 130 is equipped with a first primary flow reducer 140, preferably not adjustable, to reduce the flow in the branch 130 downstream from the flow reducer 140. The first secondary branch 132 is equipped with a first secondary flow reducer 142, preferably not adjustable, to reduce the flow in the branch 132 downstream from the flow reducer 142.

The first channel 120 also comprises a first shared branch 131, shared by all of the first air nozzles 40, 42, extending between the source 72 and each of the specific branches 130, 132. This shared branch 131 is equipped with the first valve 124.

The second primary channel 122 in turn comprises a second primary branch 134 specific to the second primary nozzles 44 and a second secondary branch 134 specific to the second secondary nozzles 46. The second primary branch 134 is equipped with a second primary flow reducer 144, preferably not adjustable, to reduce the flow in the branch 134 downstream from the flow reducer 144. The second secondary branch 136 is equipped with a second secondary flow reducer 146, preferably not adjustable, to reduce the flow in the branch 136 downstream from the flow reducer 146.

The second channel 122 also comprises a second shared branch 135, shared by all of the second air nozzles 40, 42, extending between the source 72 and each of the specific branches 134, 136. This shared branch 135 is equipped with the second valve 126.

Each of the first and second valves 124, 126 is advantageously formed by an all-or-nothing valve.

Furthermore, in this second example embodiment, the control system 100 comprises a first control module 154 to control the first valve 124, and a second control module 156 to control the second valve 126.

Each of the control modules 154, 156 has a connection for a control member (not shown) and is suitable for actuating the valve 124, 126 that it commands when the control member is connected to said connection. For example, the control member is a pneumatic actuator, the control module 154, 156 then comprising a pneumatic circuit connecting the connection of said module 154, 156 to the valve 124, 126 controlled by said module 154, 156, said valves 124, 126 then being formed by a pneumatically-controlled valve. Alternatively, the control member is a hydraulic actuator, the control module 154, 156 then comprising a hydraulic circuit connecting the connection of said module 154, 156 to the valve 124, 126 controlled by said module 154, 156, said valves 124, 126 then being formed by a hydraulically-controlled valve. Also alternatively, the control member is an electric actuator, the control module 154, 156 then comprising an electric circuit connecting the connection of said module 154, 156 to the valve 124, 126 controlled by said module 154, 156, said valves 124, 126 then being formed by an electrically-controlled valve.

A method for covering an object (not shown), typically a motor vehicle body, with the coating product, using the coating installation 2, will now be described.

The coating installation 2 is first provided with the bowl 12 mounted on the body 14. A first narrow surface, for example forming the edge of a roof of the body, is then placed across from the rotary projector 10 and the control module 102 (or 154 if one is in the case of the second example embodiment) is actuated, so as to open the supply of the inside air nozzles 40, 42 with air.

The rotary projector 10 is next activated, i.e., the supply system 18 is started, and the variable valves 93, 97 are opened to allow the supply of the air nozzles 40, 42 with air. The rotary projector 10 then begins to project a jet of coating product, which, owing to the air ejected by the inside nozzles 40, 42, is shaped narrowly. The narrow surface can thus be covered without wasting coating product.

Once the narrow surface is covered, the rotary projector 10 is deactivated, and a second, extended surface of the object, for example the center of the roof of the body, is placed in front of the rotary projector. The control module 102 (or 154 if one is in the situation of the second example embodiment) is then deactivated so as to close the supply of the inside air nozzles 40, 42 with air, and the control module 104 (or 156 if one is in the situation of the second example embodiment) is actuated so as to open the supply of the outside air nozzles 44, 46 with air, the bowl 12 remaining mounted on the body 14. Alternatively, if the bowl 12 is adapted only for projecting coating product in a narrow jet, the bowl 12 is disassembled from the body 14 and replaced by the second spraying member with a diameter larger than that of the bowl 12.

Once these changes are made, the rotary projector 10 is reactivated. The jet of coating product projected by the rotary projector 10 is then shaped widely owing to the air ejected by the outside nozzles 44, 46. The extended surface can thus be covered quickly and with a high covering quality.

When one wishes to return to a narrow jet of coating product, the rotary projector 10 is deactivated, the control module 104 (or 156 if one is in the situation of the second example embodiment) is deactivated so as to close the supply of the outside air nozzles 44, 46 with air, and the control module 102 (or 154 if one is in the situation of the second example embodiment) is actuated so as to open the supply of the inside air nozzles 40, 42 with air, the rotary projector 10 next being reactivated.

It will be noted that it is also possible to use the method described above to coat different objects, some large and others small, the adjustment of the width of the jet being done when one goes from a small object to a large object, and vice versa.

Owing to the invention described above, it is thus possible to produce wide and narrow jets of coating product with a same rotary projector, which imparts considerable flexibility to the use of this rotary projector.

It will be noted that although the above description is reduced to the case in which there are four series of nozzles 41, 43, 45, 47, the invention is not limited to this embodiment alone, and also extends to all cases in which there are at least three series of nozzles 41, 43, 45, 47, the pairs of series 48, 49 sharing, in the case where there are three series of nozzles 41, 43, 45, 47, a shared series of nozzles.

It will also be noted that, rather than being grouped together by pairs, as is described above, the series of nozzles 41, 43, 45, 47 can be grouped together by groups of three or more series 41, 43, 45, 47 to form shaping air, and/or some of the series 41, 43, 45, 47 may be isolated from the others to form a shaping air.

It will also be noted that although the above description is reduced to the case in which the first nozzles 40, 42 are positioned inside a separating perimeter, the second nozzles 44, 46 being positioned outside this separating perimeter 54, the invention is not limited to only this embodiment, and extends to all possible relative positions of the nozzles 40, 42, 44, 46, in particular the positions for which the second nozzles 44, 46 are positioned inside a separating perimeter, the first nozzles 40, 42 being positioned outside this separating perimeter, and the positions for which the first and second nozzles 40, 42, 44, 46 are positioned on a shared contour.

The invention claimed is:

1. A shaping ring for a rotary projector, the rotary projector configured to project a jet of coating product on a surface, the shaping ring comprising:

a first series of nozzles comprising a plurality of air ejection nozzles each fluidly connected to a first shared supply chamber, a second series of nozzles comprising a plurality of air ejection nozzles each fluidly connected to a second shared supply chamber, and a third series of nozzles comprising a plurality of air ejection nozzles each fluidly connected to a third shared supply chamber;

a fourth series of nozzles comprising a plurality of air ejection nozzles each fluidly connected to a fourth shared supply chamber;

wherein each shared supply chamber is separate from the other shared supply chambers;

wherein each of the air ejection nozzles is configured to eject a jet of air such that the jets of air ejected by the plurality of air ejection nozzles combine to form a shaping air flow adapted to shape the jet of coating product;

wherein a first group of nozzles comprises at least the first series of nozzles and the third series of nozzles, and a second group of nozzles comprises at least the second series of nozzles and the fourth series of nozzles, wherein the first group of nozzles is configured such that, when the nozzles of the first group of nozzles is supplied with air, the nozzles of the first group of nozzles eject jets of air that together form a first shaping air flow adapted to shape the jet of coating product such that the jet of coating product has a first width, wherein the second group of nozzles is configured such that, when the nozzles of the second group of nozzles is supplied with air, the nozzles of the second group of nozzles eject jets of air that together form a second shaping air flow adapted to shape the jet of coating product such that the jet of coating product has a second width that is greater than the first width; and wherein each air ejection nozzle of the first series of nozzles is configured for ejecting an air jet along a first direction, and each air ejection nozzle of the second series of nozzles is configured for ejecting an air jet along a second direction different from the first direction.

2. The shaping ring according to claim 1, wherein none of the nozzles of the first group of nozzles are included in the second group of nozzles and none of the nozzles of the second group of nozzles are included in the first group of nozzles.

3. The shaping ring according to claim 1, wherein the first direction is defined by a first unitary vector having a first radial component, and the second direction is defined by a second unitary vector having a second radial component, the second radial component being greater than the first radial component.

4. The shaping ring according to claim 1, wherein the first direction is defined by a first unitary vector having a first orthoradial component, and the second direction is defined by a second unitary vector having a second orthoradial component, the second orthoradial component being greater than the first orthoradial component.

5. The shaping ring according to claim 1, wherein each of the first and second directions is defined by a unitary vector having a non-zero orthoradial component.

6. The shaping ring according to claim 1, wherein the nozzles of the first series of nozzles and the nozzles of the third series of nozzles are positioned alternating relative to one another.

7. The shaping ring according to claim 1, wherein the first group of nozzles are positioned within a separating perimeter, the second group of nozzles being positioned outside the separating perimeter.

8. A rotary projector for a coating product including:

at least one spraying member for spraying the coating product, wherein the spraying member comprises a bowl with a distribution surface extending from an upstream end to a downstream end, the spraying member further comprising a spraying edge at the downstream end, the at least one spraying member configured to rotate around a rotation axis, wherein the spraying edge of the at least one spraying member is configured to form a jet of coating product when coating product is supplied to the upstream end and the spraying member rotates around the rotation axis, and a stationary shaping ring, wherein the stationary shaping ring is made up of the shaping ring according to claim 1, each of the supply chambers being formed in the rotary projector.

9. The rotary projector according to claim 8, wherein the sprayer has at least one edge defining a circle, each of the air ejection nozzles being at a distance from the rotation axis greater than or equal to the half-diameter of the circle.

10. A spraying robot containing an articulated arm, a wrist mounted at one end of the articulated arm, and a rotary projector attached on the wrist, wherein the rotary projector is a rotary projector according to claim 8.

* * * * *